US011192220B2

(12) United States Patent
Abunameh et al.

(10) Patent No.: US 11,192,220 B2
(45) Date of Patent: Dec. 7, 2021

(54) OPEN END RATCHET WRENCH

(71) Applicants: Hani A. Abunameh, Amman (JO); Mutaz O. Mango, Amman (JO)

(72) Inventors: Hani A. Abunameh, Amman (JO); Mutaz O. Mango, Amman (JO)

( * ) Notice: Subject to any disclaimer, the term of this patent is extended or adjusted under 35 U.S.C. 154(b) by 714 days.

(21) Appl. No.: 15/073,047

(22) Filed: Mar. 17, 2016

(65) Prior Publication Data

US 2016/0297054 A1 Oct. 13, 2016

(30) Foreign Application Priority Data

Apr. 8, 2015 (CN) ..... 201510163744

(51) Int. Cl.
*B25B 13/46* (2006.01)
*B25B 13/48* (2006.01)
*B25B 13/08* (2006.01)

(52) U.S. Cl.
CPC ..... *B25B 13/463* (2013.01); *B25B 13/08* (2013.01); *B25B 13/481* (2013.01)

(58) Field of Classification Search
CPC ..... B25B 13/463; B25B 13/08; B25B 13/481; B25B 13/46; B25B 13/466; B25B 13/14
See application file for complete search history.

(56) References Cited

U.S. PATENT DOCUMENTS 1,890,213 A * 12/1932 Fredericks ..... B21F 15/00 140/119
2,578,686 A * 12/1951 Fish ..... B25B 13/462 81/124.2
3,635,654 A * 1/1972 McFarland ..... B25B 13/463 405/210
3,709,073 A * 1/1973 Kurtz ..... B25B 13/08 76/114
4,819,521 A * 4/1989 Lang ..... B25B 13/463 81/177.1
D312,198 S * 11/1990 Cooke ..... D8/25
5,029,497 A * 7/1991 Junkers ..... B25B 21/005 81/57.39
5,119,701 A * 6/1992 Wei ..... B25B 13/463 81/63
5,671,643 A * 9/1997 Henkhaus ..... B25B 13/461 81/57.39
6,101,902 A * 8/2000 Wei ..... B25B 23/108 81/177.1

* cited by examiner

*Primary Examiner* — Brian D Keller
(74) *Attorney, Agent, or Firm* — Sughrue Mion, PLLC

(57) ABSTRACT

A wieldy unidirectional small swing-angle ratcheting wrench devised for torqueing hexagonal nut fasteners axially placed on hydraulic hoses or similar lines. The invention is formed of a pair of facing matching mirror image bident-shaped solid skins bound together through a solid flat filler sandwiched between the handle sections, which also functions as a mechanical support and spacer. The head cavity houses within its U-shaped elliptical head section a wrenching mechanism comprised of an open-ended ratcheting cog wheel with a central hexagonal slot of definite size. The cog wheel is ratcheted by two spring-biased pawls deployed inside the assembled tool's neck cavity which provide continuous alternating unidirectional engagement, while the outer solid skins at the head are suitably shaped to allow protrusion of the cog wheel's teeth at the sides for simple direct rotation of the wheel for alignment of the cog wheel's and skins' openings together for engagement and removal of the tool.

6 Claims, 11 Drawing Sheets

Section AA

Section BB

OPEN END RATCHET WRENCH

BACKGROUND/FIELD OF THE INVENTION

This application claims priority from Chinese Patent Application No. 201510163744.X, filed on Apr. 8, 2015 in the State Intellectual Property Office of the People's Republic of China, the disclosure of which is hereby incorporated by reference in its entirety.

Wrenches can be divided into two categories: closed-end—also known as ring-type—and open-end wrenches. Closed-end wrenches are those which must be applied axially to a nut, bolt head, or other torque-receiving surface, while open-end wrenches are those which can be applied either axially or radially to a torque receiving surface.

Closed-end wrenches typically have four to eight contact faces, and are usually designed to contact all torque-receiving surfaces at the same time. Such wrenches are typified by common box or socket type wrenches. This category of wrench generally comprises a torqueing head solidly attached to a slender arm. The torqueing of a nut by a closed end wrench, especially in confined areas, generally entails the continuous placement and removal of the wrench head to the nut to complete a torqueing operation.

Another version of closed-end wrenches is the ratcheting type, whereby the head comprises a nut-engaging slot or socket cog wheel with a ratcheting mechanism which allows continuous torqueing of a nut through 360° ad infinitum without the need for disengaging it from the torque-receiving surface. However, closed-end wrenches in both solid and ratcheting forms cannot be used for torqueing nuts or fasteners axially placed on hydraulic or similar lines in view of the geometry of the torqueing head.

Open-end wrenches typically engage two sides of a nut, perform the same function as closed-end wrenches, and, in view of the geometry of the head, allows for engagement to nuts or fasteners axially placed on hydraulic or similar lines. However, torqueing such nuts or fasteners, especially in confined environments, entails continuous placement and removal of the wrench head to the nut to complete a torqueing operation, which can be arduous and time-consuming. An ideal tool that would facilitate such operations would be a ratcheting wrench that can be securely engaged on axially-placed nuts or fasteners and remain engaged throughout the torqueing operation in a manner identical to normal ratcheting ring wrenches. Such wrench will have to satisfy various criteria such as tool integrity, reliability, size, simplicity and economy to be commercially viable. The apparatus taught herein is such a tool designed for ratcheting hard-to-reach nut fasteners in an efficient and convenient manner by ensuring efficient secured encapsulation of the nut throughout the wrenching and ratcheting process using a relatively small tool that is easy to engage, use and remove by the user, with a small ratcheting swing-angle, as well as being easy to navigate in confined spaces, such as under a car's hood or amongst a bathroom's plumbing fixtures. The tool has been designed with focus on economy and reliability through having minimal moving parts that are simple to manufacture and assemble, which makes it affordable to anyone from hobbyists to DIY persons as well as professionals.

PRIOR ART

Ratcheting wrenches designed for torqueing axially placed nuts on hydraulic or similar lines are taught by many in the prior art. However, none seem to satisfy all of the basic qualities required of such a wrench as described above:

U.S. Pat. Nos. 2,712,256 and 5,501,124 present solutions whereby two pairs of pawls are used to provide bidirectional torqueing, resulting in excessive head size and use of moving parts that unduly increase production cost and susceptibility of tool to dysfunction with use. Further, the tool lacks any mechanism for disengagement of the wrench other than having to rotate the head by up to 90° to align cog wheel and head openings together.

U.S. Pat. No. 2,851,914 suffers all the above-listed disadvantages. Furthermore, as the tool's cog wheel engages only four faces of a nut fastener, that can result in the nut slipping out of position when the tool is in open configuration, thus jamming the torqueing operation and possibly damaging the tool and assembly.

U.S. Pat. No. 7,895,920 tool wrench has too many components and can therefore be costly to manufacture and is susceptible to early wear with use. The disengagement of the wrench from the fastener can be problematic in confined spaces as the ratcheting wheel would have to be turned by up to 30° to align the ratcheting inserts to the open position for the swinging collars to open up.

U.S. Patent No. 5,960,679 relies on a complex mechanism that would be costly to manufacture and is susceptible to early wear with use. It also functions by repetitive engagement and disengagement thus exposing tool and nut to possible wear or damage. During ratcheting, the tool's ratcheting swing-angle of 60° can render the tool impracticable for use in confined spaces.

OBJECTS AND SUMMARY OF THE NEW INVENTION

The invention taught herein is an unidirectional open-ended small swing-angle (half of that of many standard ratchet wrenches) ratcheting wrench of practical size designed to assist in assembling, removing and tightening/loosening axially-placed fasteners or nuts attached to hydraulic or similar lines. The design concept is based upon simple criteria with minimal moving parts to ensure reliability, longevity and economy.

The invention comprises a peripherally-notched cog wheel of solid material of definite face width with a concentric hexagonal slot designed to circumscribe a single standard sized nut. The slot is peripherally circumscribed on both sides of the wheel by two integral rings of definite thickness and width forming bearing rotation shoulders for the cog wheel. The hexagonal slot is with an axial opening to the wheel's perimeter through one of its corners of a width short of the nut/fastener's "across flats" width but exceeding the hole or tie diameter of the nut/fastener.

The cog wheel is deployed to rotate peripherally around its rotation shoulders inside the head of an open-end wrench assembly made of two solid flat mirror image bident-shaped skins with elliptical heads having concentric circular apertures with axial end openings riveted facing each other along the handles to a solid filler element of a thickness minimally greater than the face width of the cog wheel. Two pawls deployed in the neck section of the wrench assembly alternately engage the cog wheel to provide uninterrupted unidirectional torqueing. Pins deployed between pawls and cog wheel check the sinking of pawls inside the cog wheel opening when the two are aligned, thus preventing the jamming of the cog wheel's rotation. The wrench's head width is of the same dimension as the root diameter of the cog wheel, thus allowing the protrusion of the cog wheel's teeth at the sides for direct and simple manual aligning of the cog wheel opening with that of the wrench for engagement and removal of the tool. Said head's axial opening's width is the same as that of the cog wheel to allow for the engagement and removal of the tool to a hydraulic or similar line.

For torqueing a hexagonal nut fastener axially placed on a hydraulic or similar line, the cog wheel opening is first aligned with that of the wrench head by manually rotating the cog wheel via the protruding cog wheel teeth at the sides. The wrench head is then pushed across the line and then sideways to engage the nut. Unidirectional ratcheting can then be performed.

Upon completion of the task, the wrench is disengaged by moving the head slightly sideways away from the nut and along the hose or line. The cog wheel opening is aligned with that of the wrench's head by manually rotating the cog wheel from the protruding cog wheel teeth at the sides, thus allowing the removal of the tool from the line. Torqueing in the opposite direction can be performed simply by flipping the wrench over to its opposite face prior to inserting the head onto the line.

BRIEF DESCRIPTION OF THE DRAWINGS

A clearer understanding of the invention will become apparent from the following drawings and their descriptions, wherein.

DETAILED DESCRIPTION OF THE PREFERRED EMBODIMENTS

For the sake of convenience and clarity, and unless otherwise specified, the invention, in all its configurations and variations, will be generically referred to as the "tool", while similar elements or components appearing in different figures will have the same reference numbers.

Figure 1:
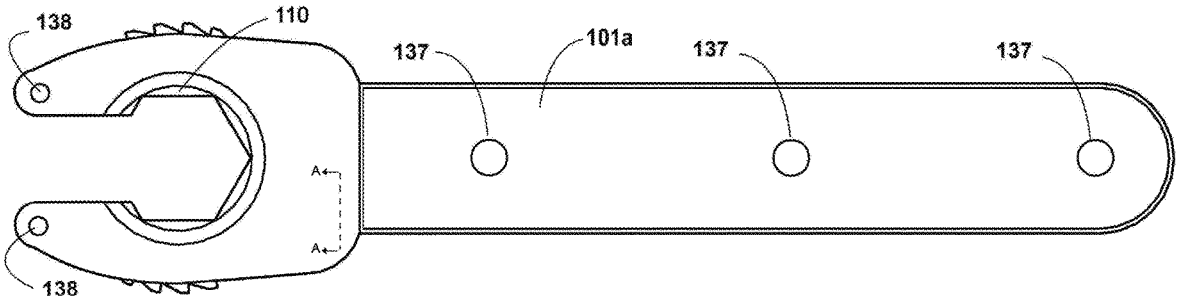
FIG. 1 is a plan view of the preferred embodiment of the invention portraying a configuration of a clockwise ratcheting operation.
Figure 2:
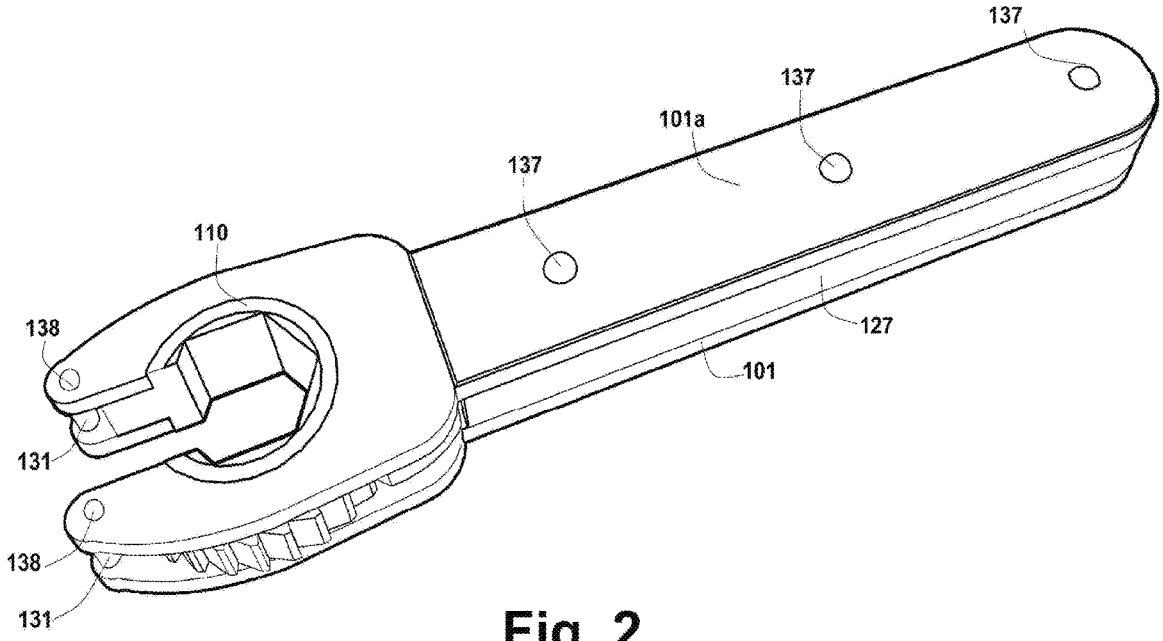
FIG. 2 is an isometric view of the embodiment of FIG. 1.
Figure 3:
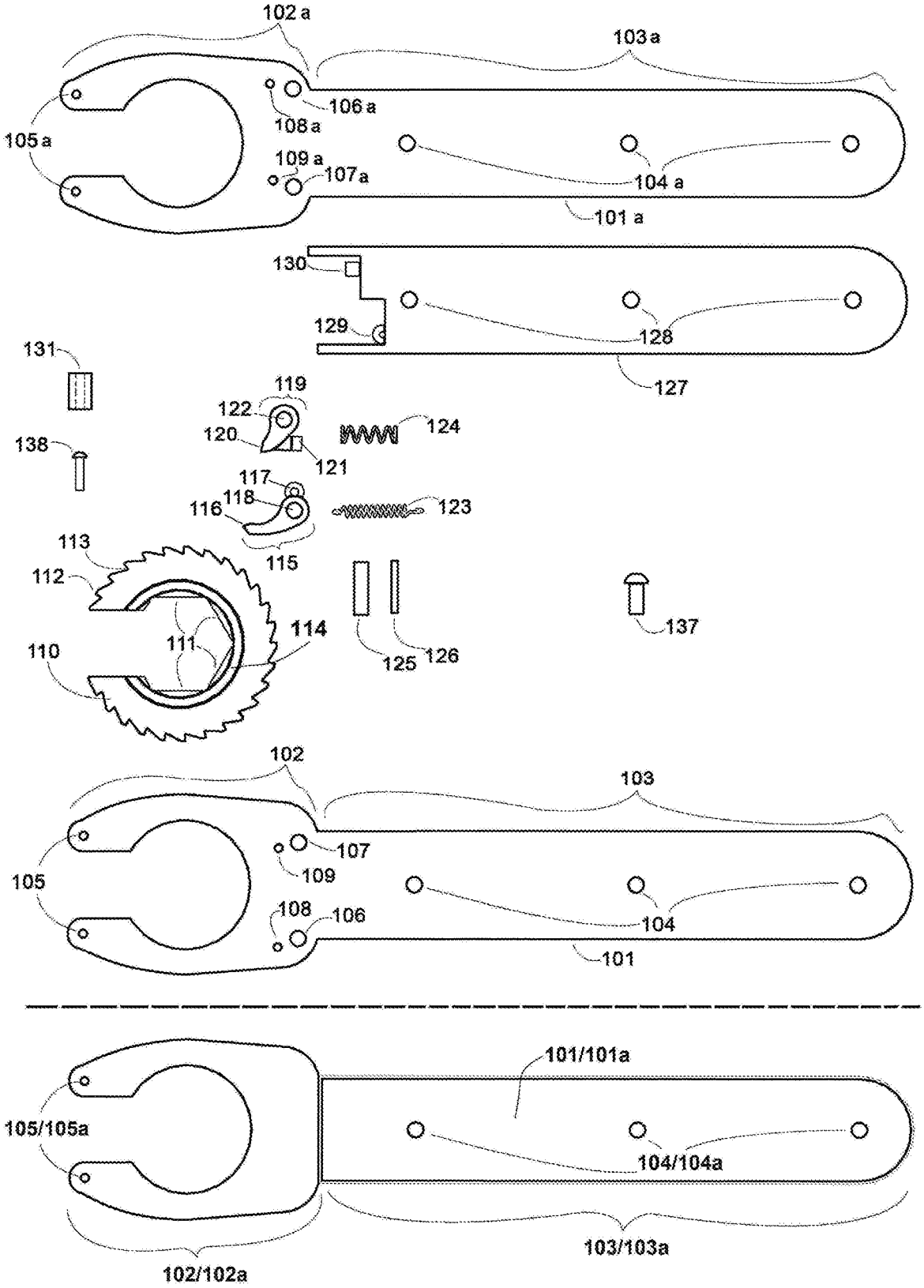
FIG. 3 is a plan view of all components of the embodiment of FIG. 1 in disassembled form.
Figure 4:
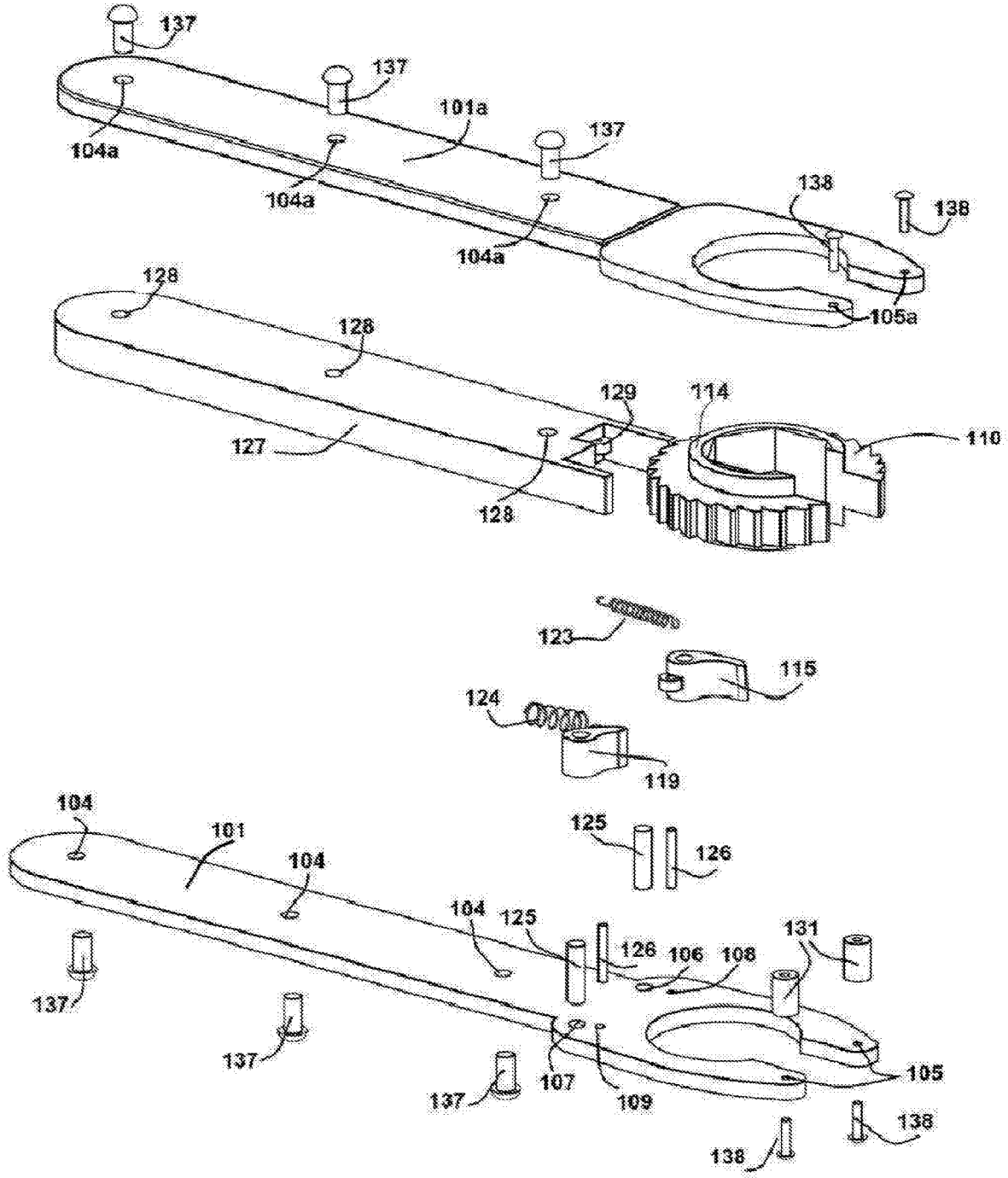
FIG. 4 is an exploded view of the embodiment of FIG. 1.
Figure 5:
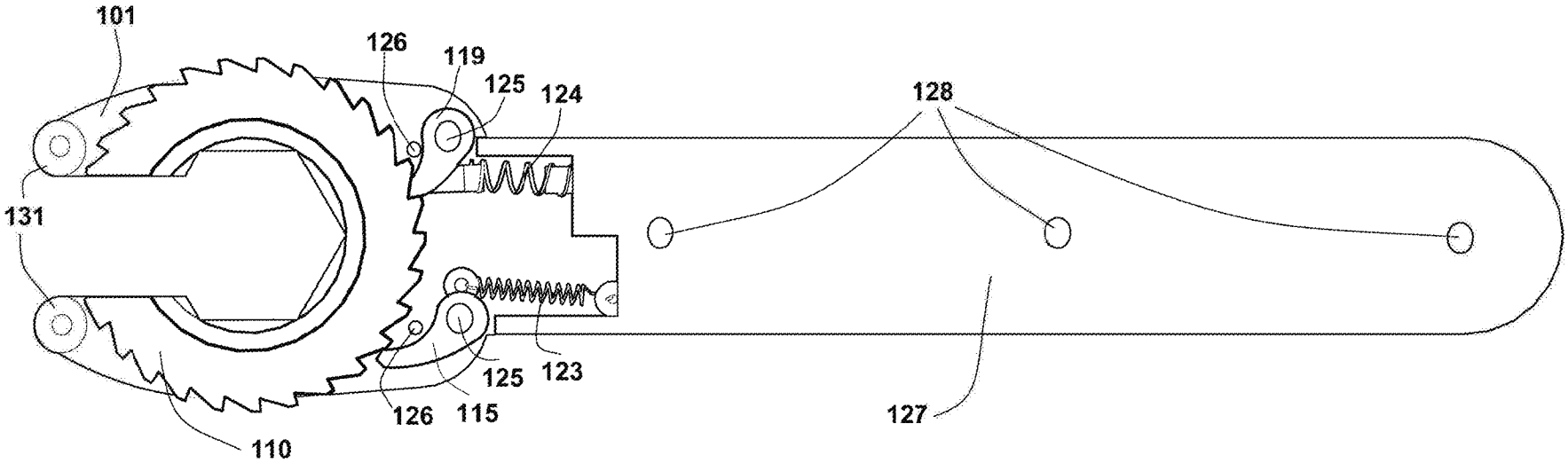
FIG. 5 is a plan view of the embodiment of FIG. 1 with top skin removed to expose its assembled ratcheting mechanism.

As shown in FIGS. 3, 4 and 5, the ratcheting mechanism of the preferred embodiment is assembled onto bottom skin 101, which contains blind holes 106, 107, 108 and 109 on the skin's internal face as components' slots, and through-holes 104 and 105 in handle section 103 and head section 102 respectively for rivet insertion. The ratcheting mechanism is made up of cog wheel 110 and two pawls 115 and 119 and their auxiliary components. Cog wheel 110 fits into the bottom skin's head region 102 in the same layout as seen in FIG. 4, such that the cog wheel's rotation shoulder 114 (FIG. 4) slips perpendicularly into the skin's circular aperture. Directionality of cog wheel's teeth 112 are matched by pawls 115 and 119's configuration. Two pivot pins 125 are slipped vertically into blind holes 106 and 107, and the same applies to two pawl retainers 126 that slip into blind holes 108 and 109. Pawl 115 is placed on skin 101 by slipping slotted pivot pin 125 through its pivot opening 118, with pawl's tip 116 pointing towards the tip of the tool, and positioned so that its shape is arcing with skin 101's curved corner adjacent to pivot pin slot 106. Pawl 119 is attached to skin 101 by slipping pivot pin 125, which is slotted into blind hole 107, through the pawl's pivot opening 122. Directionality of pawl 119 is such that its tip 120 is pointing towards cog wheel 110 and is in alignment with pawl 115. FIG. 5 shows the resulting layout of pawls 115 and 119 in relation to cog wheel 110.

Cog wheel 110 contains a hexagonal slot 111 of definite standard nut size with an axial cut-out through one corner forming an opening of a width short of the hexagonal slot's "across flats" but exceeding the hole or tie diameter of the nut or fastener, thus maintaining five corners to the slot. Both sides of wheel 110 have round shoulder projections 114 of definite thickness and width central with its axis circumscribing the central hexagonal slot for confined peripheral rotation of cog wheel within the circular apertures in skins (101 and 101*a*) of the wrench head section.

Cog wheel 110's rotation shoulder 114's external diameter is minimally smaller than skins 101's and 101*a*'s circular apertures' diameter to allow for the wheel's free rotation therein, and the axial openings in the skin heads are of the same width as the axial opening in the cog wheel. Said shoulder 114 also aids in the integrity of cog wheel 110 and supplements its strength through sharing operational stresses with the outer skins.

Pawls 115 and 119 are biased towards engagement with cog wheel 110 through tension spring 123 and compression spring 124 respectively, which are both anchored to filler 127 through ring anchor 129 and support nub 130 respectively. Filler 127 is placed onto skin 101 such that its three through-holes 128 are aligned with skin 101's three holes 104 along handle section 103 and such that its spring ring 129 is aligned with pawl 115 and its spring nub 130 is aligned with pawl 119 as shown in FIG. 5. The springs are then attached such that tension spring 123 connects pawl 115's ring 117 with filler 127's ring 129, while compression spring 124 is compressed between pawl 119's nub 121 and filler 127's nub 130. Resulting configuration is shown in FIG. 5. Alternatively a mirror image of FIG. 5 can be assembled, ensuring the correct configuration of skins (101 and 101*a*), cog wheel (110), pawls (115 and 119), springs (123 and 124) and filler (127), which, once enclosed within skins 101 and 101*a*, results in the same embodiment.

The ratcheting mechanism and filler are sandwiched between top skin 101*a* over bottom skin 101, with the skins' through-holes sides aligned. Two stiffeners/spacers 131 of the same thickness as filler 127 are placed between the skins' tips, aligned with through-holes 105 on bottom skin 101's head region 102 and through-holes 105*a* on top skin 101*a*'s head region 102*a*. Blind holes on top skin 101*a*'s face match the relevant pawl pivots 125 and retainer pins 126 protruding from the assembled ratcheting mechanism. The tool is then secured via 10 rivets: six body rivets 137, three on each external skin face via through-holes 104 and 104*a* along handle sections 103 and 103*a*, all meeting half way within filler 127's through-holes 128, as well as four small rivets 138, passing skins' through holes 105 and 105*a* and settling within stiffeners 131 in head sections 102 and 102*a*.

Figure 10:
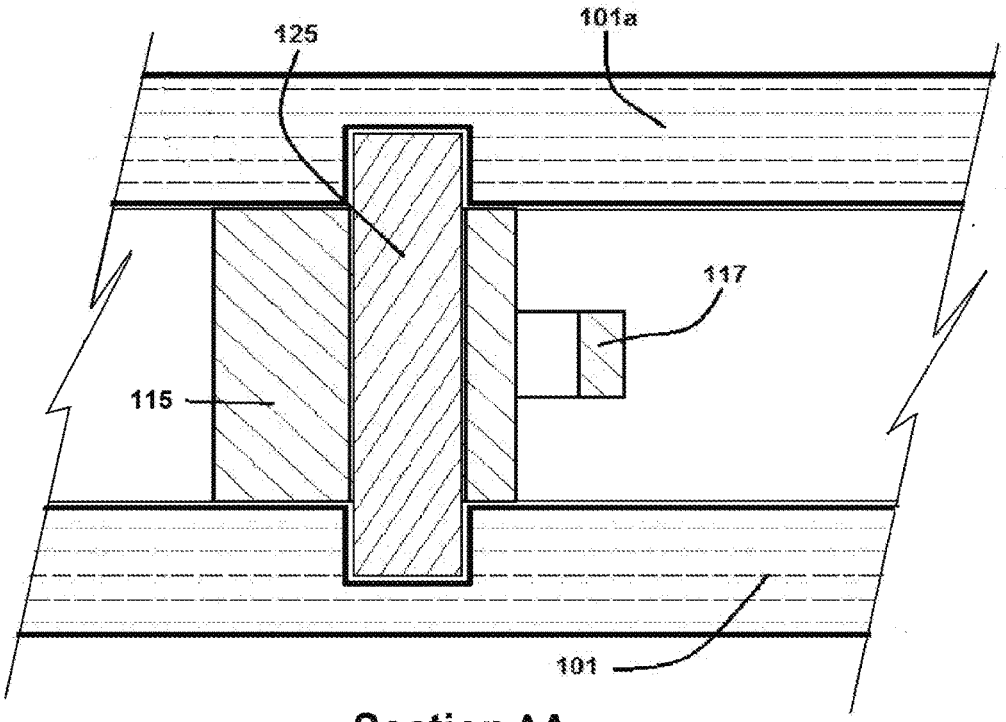
FIG. 10 is a cross-sectional view (section AA in FIG. 1) of the pawl assembly with pawl, pivot pin and outer skins of the preferred embodiment, and a cross-sectional view (section BB in FIG. 7) of the revised pawl configuration in the second embodiment of the invention.
Figure 10:
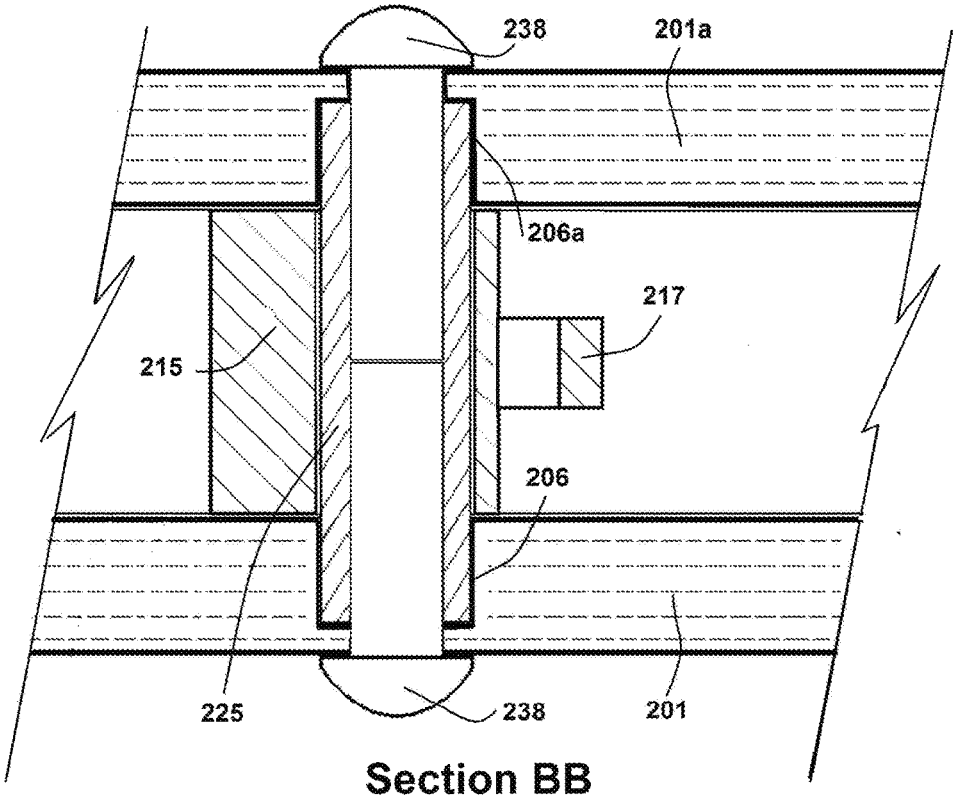

Pawls 115 and 119 are of the same thickness as the "face width" (wheel thickness) of cogwheel 110, while filler 127 and stiffeners 131—both the same thickness—are minimally greater to allow for the free movement of cogwheel and pawls between skins 101 and 101*a* during ratcheting operations FIG. 10, (section AA).

Figure 6C:
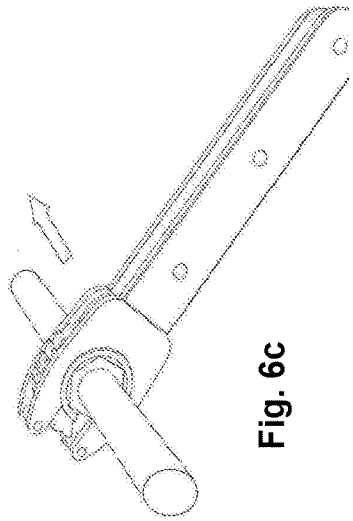
FIGS. 6*a*, 6*b*, 6*c*, 6*d*, and 6*e* are isometric presentations of the sequential steps of a typical torqueing operation of an axially placed nut by the invented tool.
Figure 6B:
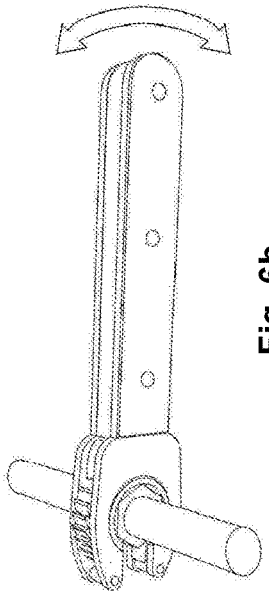
Figure 6A:
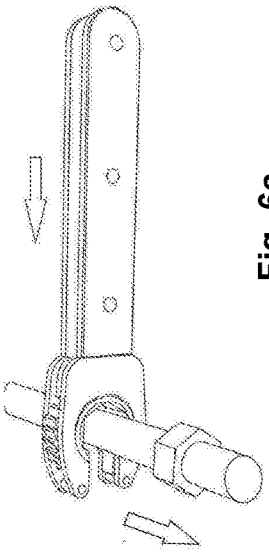

The tool's basic operating steps are described in FIGS. 6*a* through 6*e*. In a common nut-fastening/loosening scenario, the wrench head, in an open configuration—achieved by directly rotating the cog wheel via its peripherally-exposed teeth flanking the tool's head—is pushed across the line and then sideways to engage the nut (FIG. 6*a*). Once cog wheel 110 circumscribes the nut, unidirectional ratcheting can commence (FIG. 6*b*).

Figure 6E:
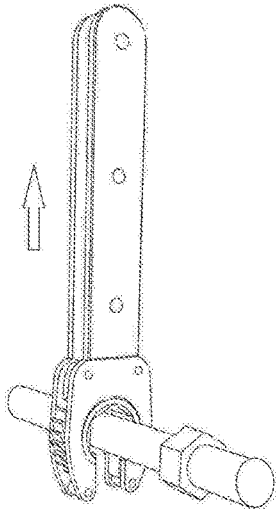
Figure 6D:
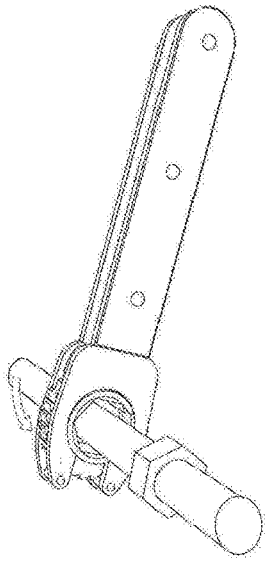

Upon completion of ratcheting, the tool is disengaged from the nut by moving it sideways along the nut's axis of rotation along the line (FIG. 6*c*). If the tool is in a closed configuration (FIG. 6*d*), the operator can manually rotate cog wheel 115 into an open configuration (FIG. 6*a*) by directly manipulating the exposed teeth flanking the sides of the tool's head (FIG. 6*d*). The tool can then be removed away from the line (FIG. 6*e*).

For reverse torqueing, the tool is flipped over to the opposite face prior to engagement to the line.

Figure 7:
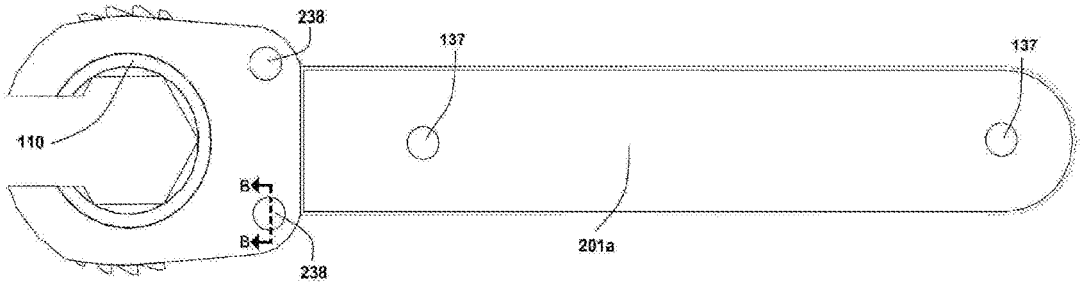
FIG. 7 is a plan view of a second embodiment of the invention with a shorter head.
Figure 8:
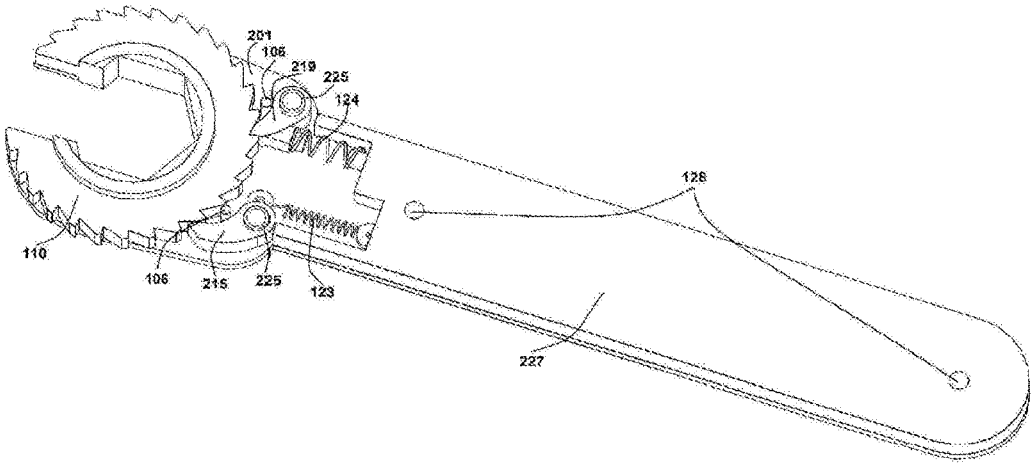
FIG. 8 is an isometric view of the embodiment of FIG. 7 with top skin removed to expose its assembled ratcheting mechanism.
Figure 9:
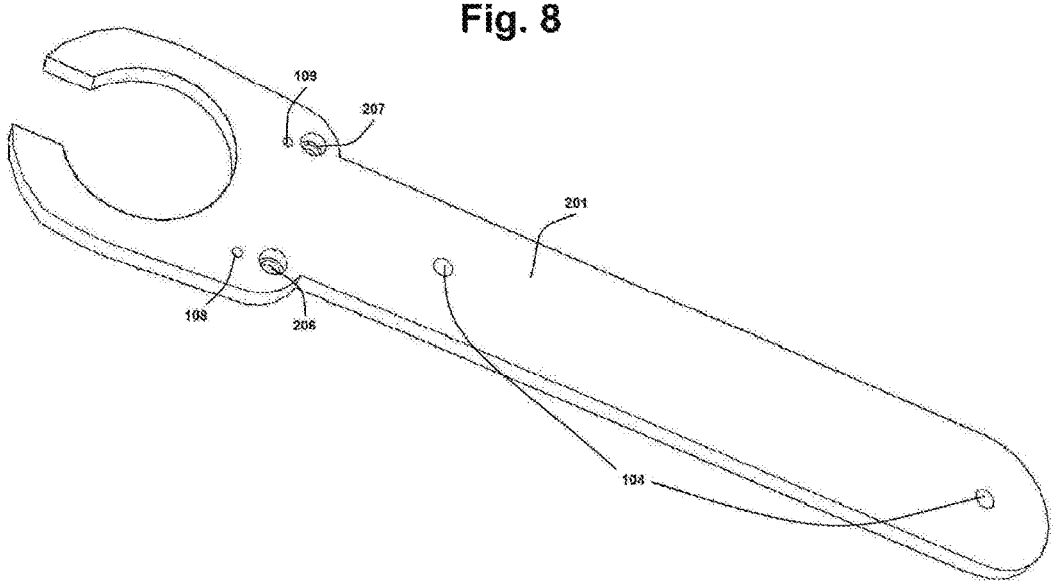
FIG. 9 is an isometric view of the inside face of one of the two mirror image skin components of the second embodiment.

According to a second embodiment of the invention, designed for smaller sized versions of the tool, and as illustrated in FIGS. 7, 8 and 9: stiffener/spacers 131 and rivets 138, as well as rivet holes 105 and 105*a* are omitted altogether, thus substituting skins 101 and 101*a* with skins 201 and 201*a* that have shorter heads, and blind holes 106 and 107 with revised blind holes 206 and 207 that are compatible with the revised pawls' configuration. Pawls 115 and 119 are substituted by pawls 215 and 219 of larger pivot hole diameters, and pivot pins 125 are substituted by cylindrical sleeves 225 that function as pivot pins, spacers and rivet anchors. Rivets 238 are driven through outer skins 201 and 201*a* into anchors 225. A cross section of the pawl assembly is illustrated in FIG. 10 (section BB).

Figure 11:
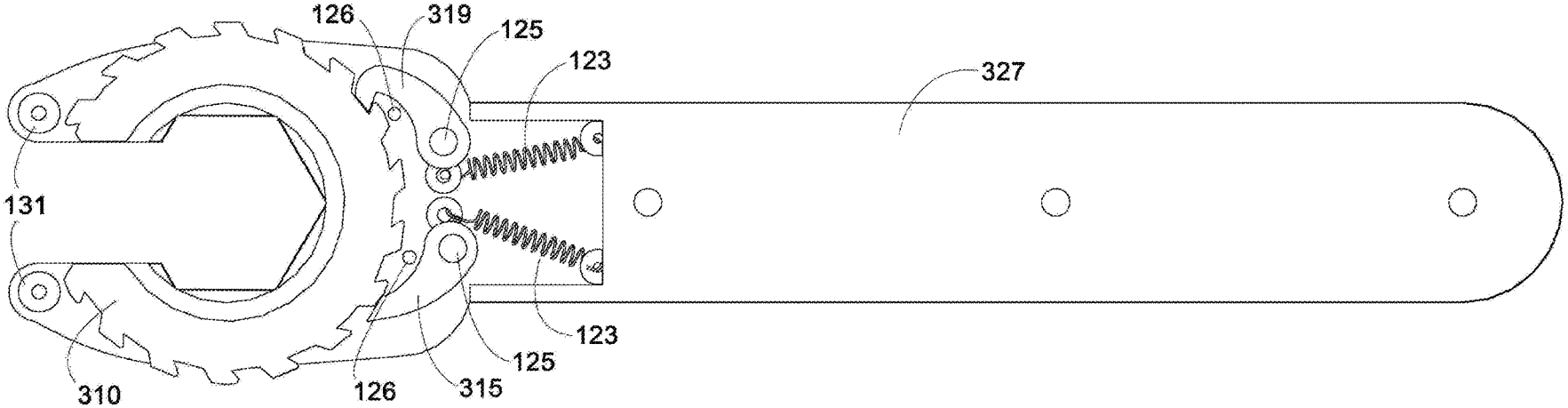
FIG. 11 is a plan view of a third embodiment of the invention with top skin removed to reveal the assembled ratcheting mechanism.

According to a third embodiment of the invention illustrated in FIG. 11: Cog wheel 110 is replaced by another 310 of similar dimensions but of different teeth configuration to allow for the introduction of a tension pawl 319 to replace compression pawl 119. This entails changing compression pawl 115 by another 315 of compatible shape, and filler/spacer 127 with another 327 that allows for replacing compression spring 124 with tension spring 123. Outer skins 101 and 101*a* are substituted by similar ones 301 and 301*a* that provide for the revised configurations of blind holes 106, 107, 108 and 109.

Figure 12A:
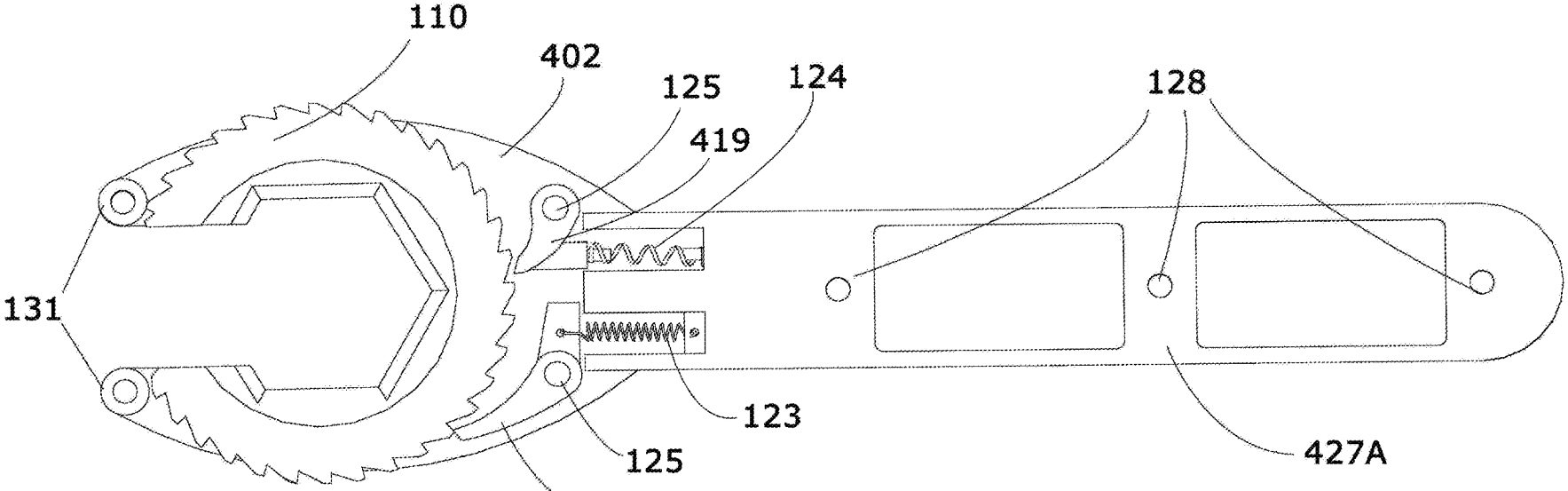
FIGS. 12*a* and 12*b* are plan views of a fourth embodiment of the invention with a revised mechanism for the retention of the pawls when not engaged to the cog wheel.
Figure 12B:
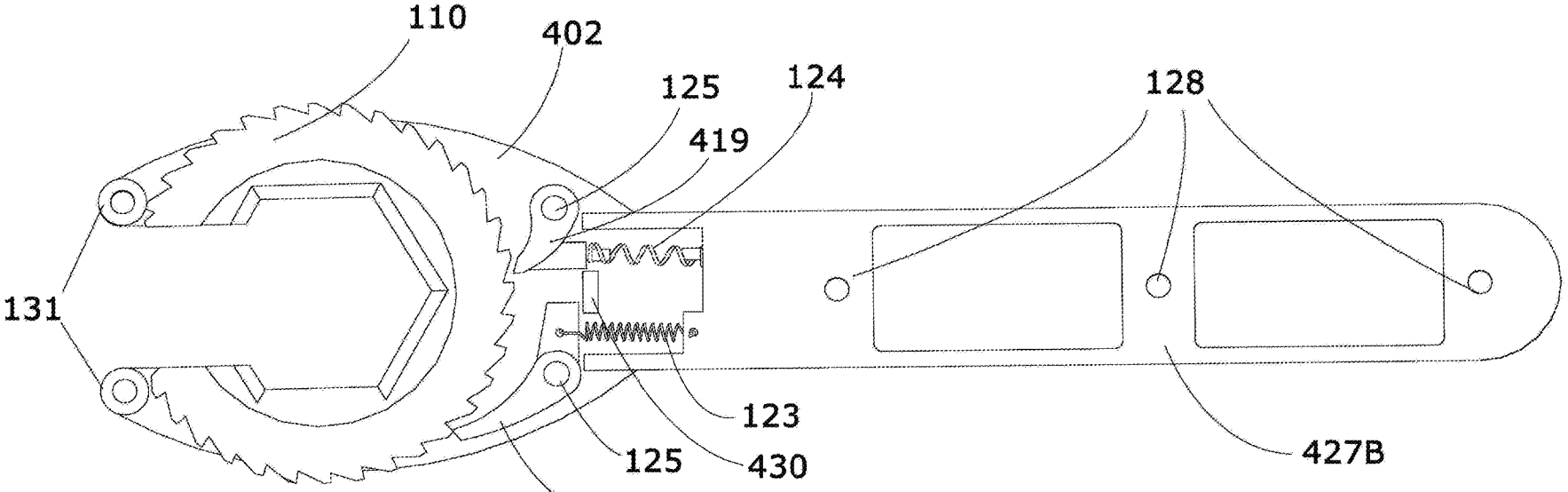

According to a fourth embodiment of the invention illustrated in FIGS. 12*a* and 12*b*: Pawl retention pins 126 are omitted altogether and substituted by a modified filler 427A, as shown in FIG. 12*a*, or by a stud 430 of any suitable shape (shown rectangular) attached to skin's head region 402 and deployed between the pawls' pivots and filler 427B, as shown in FIG. 12*b*. Both pawls 415 and 419 are modified to fit the resulting retention method's geometry.

Figure 13:
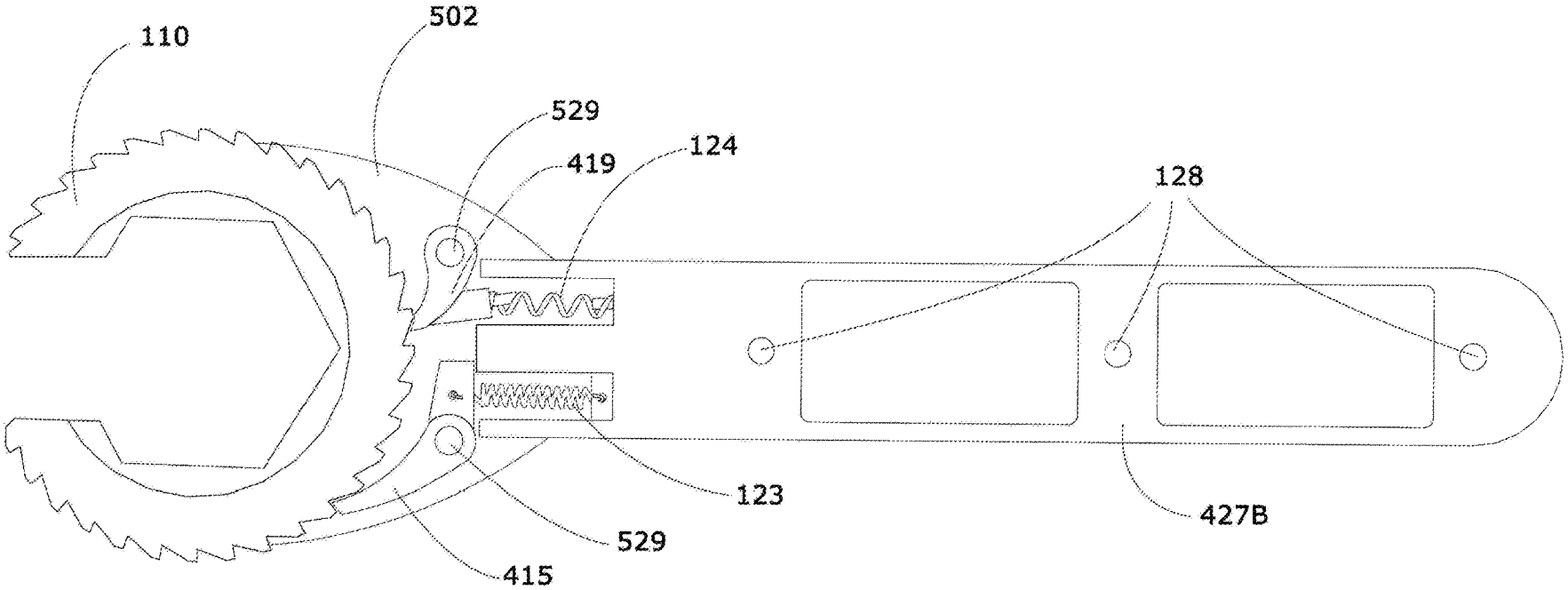
FIG. 13 is a plan view of a fifth embodiment of the invention in FIG. 12*a* with the stiffeners at the wrench's tip omitted and the pawls' pivots replaced by rivets also acting as pivots.

According to a fifth embodiment of the invention illustrated in FIG. 13: The fourth embodiment of the invention as illustrated in FIGS. 12*a* and 12*b* are further modified by omitting stiffeners 131 altogether, resulting in a shorter skin's head 502, as well as substituting pawls' pivots 125 with rivets 529 which penetrate through outer skin's head 502 and double up as pawl pivots.

Although the invention has been described with reference to particular embodiments, it is to be appreciated that various adaptations and modifications may be made within the spirit of the invention.

The invention claimed is:

1. An open end unidirectional ratcheting wrench comprising:

(a) a pair of facing matching mirror image bident-shaped solid outer skins bound together through a solid or castellated flat filler, the outer skins each comprising a handle sections that functions as a mechanical support and spacer, thus forming the open end unidirectional ratcheting wrench with a head section, a neck section and the handle section, a cog wheel that contains a plurality of notches around a perimeter of the cog wheel, and the cog wheel is of a solid material of definite thickness that allows for rotation in the head section as assembled, the head section being elliptical in shape with an opening at a distal end that leads to a circular aperture portion to accommodate the cog wheel, and sides of the head section being dimensioned to allow for a protrusion of teeth of the cog wheel to enable direct manual rotation of the cog wheel;

(b) the cog wheel having a concentric hexagonal slot of a definite standard nut size with an axial cut-out through one corner of the hexagonal slot forming an opening of a width of the hexagonal slot across opposing flats thus maintaining five corners to the hexagonal slot, and the hexagonal slot being peripherally circumscribed by two integral rings of a definite thickness and width, forming bearing rotation shoulders for the cog wheel for peripheral rotation within the circular aperture portion in the outer skins of the head section;

(c) two or more freely rotating compression spring-biased pawls deployed in the neck section and pivotally supported on pins or rivets sandwiched between and sunk into the outer skins distanced apart so as to alternately or simultaneously secure continuous single unidirectional engagement with the cog wheel, the two or more pawls being dimensioned to freely rotate around pivots and between the outer skins;

(d) a first compression pawl, of the two or more pawls, biased through a tension spring anchored at one end to a ring peripherally attached to a shaft of the first compression pawl and at an other end to a ring on one side of a top end of the solid or castellated flat filler within the handle section; and (e) a second compression pawl, of the two or more pawls, biased through a compression spring securely seated at one end on a nub on a backside of the second compression pawl and at an other end on a nub on an other side of the top end of the solid or castellated flat filler within the handle section (f) two pins in the neck section sandwiched between and sunk into the outer skins and deployed between the two or more pawls and the cog wheel to prevent the two or more pawls from swinging into the opening of the cog wheel when the two pins are aligned, the two pins being positioned so as to be clear of the protrusion of teeth of the cog wheel and of the two or more pawls when the two pins are engaged to the cog wheel.

2. The wrench according to claim 1, further comprising two cylindrical stiffener spacers of a same thickness as that of the solid or castellated flat filler in the handle section deployed between the outer skins at a tip of a head opening of the wrench and penetrated by rivets driven through the outer skins.

3. The wrench according to claim 2, wherein the two or more pawls comprise shafts pivoted on cylindrical spacers sandwiched between and sunk into the outer skins, and the rivets are driven through the outer skins and sunk into the cylindrical spacers.

4. The wrench according to claim 1, awherein the two or more pawls further comprises a tension pawl biased through a tension spring anchored at one end to a peripherally-deployed ring to a shaft of the tension pawl and at an other end to a ring positioned on one side of the top end of the solid or castellated flat filler within the handle section.

5. The wrench according to claim 1 wherein the teeth of the cog wheel are configured to provide a secure peripheral engagement with a tension pawl and the first or seconds compression pawl.

6. The wrench according to claim 1, further comprising a retention element either as part of the solid or castellated flat filler or as a retention stud protruding from an internal face of one of the outer skins, the retention element preventing the two or more pawls from swinging into the opening of the cog wheel when so aligned.

* * * * *